United States Patent [19]

Van Dal

[11] Patent Number: 4,722,458

[45] Date of Patent: Feb. 2, 1988

[54] DISPENSING VALVE

[75] Inventor: David J. Van Dal, Applecross, Australia

[73] Assignee: Kiff Pty. Ltd., Perth, Australia

[21] Appl. No.: 871,434

[22] PCT Filed: Oct. 1, 1985

[86] PCT No.: PCT/AU85/00240

§ 371 Date: May 6, 1986

§ 102(e) Date: May 6, 1986

[87] PCT Pub. No.: WO86/02062

PCT Pub. Date: Apr. 10, 1986

[30] Foreign Application Priority Data

Sep. 28, 1984 [AU] Australia ..... PG7429

[51] Int. Cl.[4] ..... B65D 35/56; B67D 3/00

[52] U.S. Cl. ..... 222/105; 222/513; 222/517; 222/529; 222/541

[58] Field of Search ..... 222/513, 522, 518, 529, 222/528, 527, 559, 541, 517, 105; 251/251

[56] References Cited

U.S. PATENT DOCUMENTS

| | | | |
|---|---|---|---|
| 2,661,128 | 12/1953 | Rieke | 222/529 |
| 4,169,548 | 10/1979 | Bond | 222/505 |
| 4,294,382 | 10/1981 | Summers et al. | 222/529 |
| 4,368,832 | 1/1983 | Lambert | 222/509 |
| 4,440,316 | 4/1984 | Christine | 222/518 X |
| 4,570,826 | 2/1986 | Fattori | 222/518 X |

FOREIGN PATENT DOCUMENTS

| | | | |
|---|---|---|---|
| 80/02546 | 11/1980 | PCT Int'l Appl. | 222/529 |

*Primary Examiner*—Joseph J. Rolla
*Assistant Examiner*—Gregory L. Huson
*Attorney, Agent, or Firm*—Harness, Dickey & Pierce

[57] ABSTRACT

A dispensing valve for a fluid container comprising a tubular body portion having an inlet at one end adapted to be mounted to a container, the other end of the tubular portion is closed by a resiliently deformable diaphragm, a discharge outlet in the wall of the tubular portion, a flow control member positioned within said tubular portion and coupled to the diaphragm for movement relative to the discharge outlet between a closed position and an open position on deformation of the diaphragm.

10 Claims, 5 Drawing Figures

DISPENSING VALVE

This invention relates to an improved dispensing valve for containers for fluids and particularly containers of the "bag-in-box" variety.

The object of the invention is to provide a dispensing valve which is relatively easy to operate.

With most bag-in-box type dispensing arrangements currently in use the dispenser is fitted to a spout which is welded to the bag and filling of the bag is effected through the spout. To fill the bag the dispenser in most cases is removed from the spout prior to filling and on completion of filling is replaced over the spout. This usually requires that the dispenser closure be separate from the spout prior to filling or that the dispenser closure be loosely fitted to the spout prior to filling. As a result there is a high risk of contamination due to the resultant exposure of the internal surfaces of the spout and dispenser closure.

In addition when the dispenser is in position on the spout on completion of filling there is always the danger that it may become dislodged in use or during transport causing the loss of contents of the bag. Furthermore there is always the possibility of leakage of liquid from the bag and/or the entry of air into the bag through the junction between the dispenser closure and spout.

Furthermore to use the valve the whole fitting must be extracted from within and fitted to the carton before use.

It is an object of this invention to provide a sealed dispenser closure which is sealingly retained to the container with which it is associated.

It should be appreciated however that the invention need not be limited to use with bag-in-box type containers.

In one form the invention resides in a dispensing valve for a fluid container comprising a tubular portion having an inlet at one end and closed by a resiliently deformable diaphragm at its other end, a discharge outlet provided in the wall of the tubular portion, a flow control member positioned within the tubular portion and coupled to the diaphragm for movement relative to the discharge outlet between a closed position and an open position on deformation of the diaphragm.

According to a preferred feature of the invention the dispensing valve has a flexible skirt adapted at one end to be sealingly engaged with an opening in the container and fixed at its other end to the one end of said tubular portion whereby said valve is movable in relation to the one end of the flexible skirt such that when in position on a container the valve may be located within the container in an inoperative position or located to the exterior of the container in an operative position.

According to a further preferred feature of the invention a seal is fixed or integrally formed over the discharge outlet, said seal being adapted to be capable of being torn or cut away to expose said discharge port.

According to further preferred feature of the invention the valve is mounted to a flexible container which is accommodated within a rigid container.

The invention will be more fully understood in the light of the following description of one specific embodiment. The description is made with reference to the accompanying drawings of which:

The embodiment is intended for use with bag-in-box type packaging. The valve comprises a body having an inlet 11 formed with a flange 18 which is adapted to be fixed to the opening of a flexible inner container (not shown). A radially outwardly directed groove 19 is formed around the body adjacent the flange 18. The purpose of the groove 19 is to facilitate engagement with the wall of the rigid outer container which houses the flexible inner container.

Figure 1:
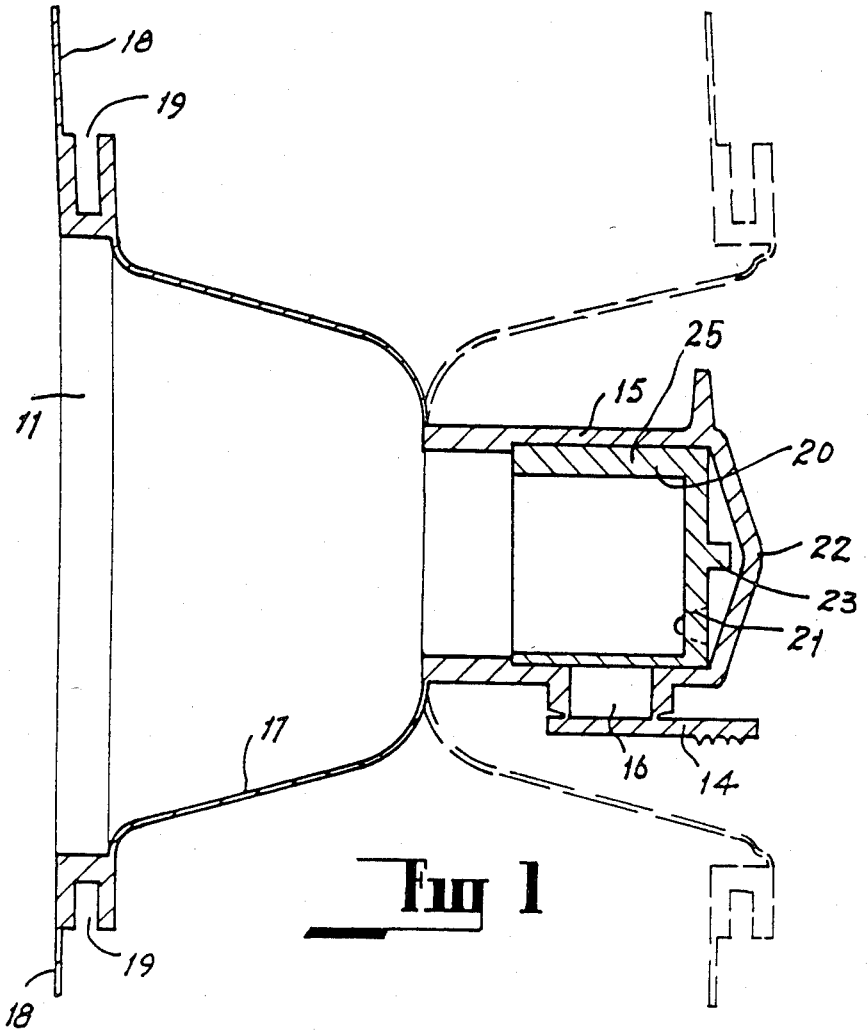
FIG. 1 is a sectional elevation of a dispenser valve according to the embodiment.
Figure 3:
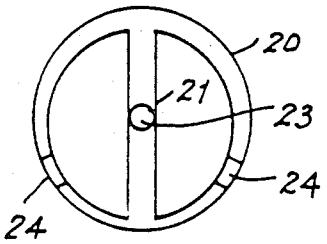
FIG. 3 is an end elevation of the flow control member of the valve.
Figure 4:
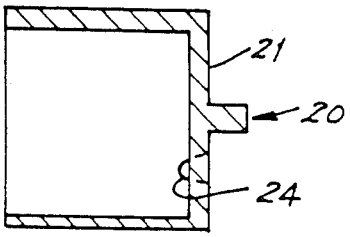
FIG. 4 is a side elevation of the flow control member.

The body comprises a tubular flexible resilient skirt 17 extending from the inlet 11 and fixed at its outer end to a rigid tubular portion 15. The flexible resilient skirt 17 provides a flexible interconnection between the flange 18 and the rigid tubular portion 15 whereby the tubular portion 15 may be moved in relation to the flange 18 to be located to either side of the plane of the flange 18 as shown in FIG. 1 in which the inoperative position at which the valve is located within the container is shown in broken lines and the operative position in which the valve is located to the exterior of the bag and flange 18 is shown in solid lines.

The rigid tubular portion 15 is formed at its outer end with a flexible diaphragm 22 which extends over the outer end to close that end. In addition the tubular wall of the rigid tubular portion 15 is formed with a discharge outlet 16. The discharge outlet 16 is closed by a removable seal 14. In manufacture the body comprising the flange 18 flexible skirt 17 rigid tubular portion 15 diaphragm 22 and removable seal 14 is formed by any suitable moulding technique as a single item. The junction between the removable seal and the discharge outlet 16 is such that the removable seal may be readily cut or torn away from the discharge outlet when it is required to use the valve.

The interior of the rigid tubular portion 15 is formed with a rebated portion 25 in the region of the discharge outlet in order to accommodate a closure member 20 which is of tubular configuration and has dimensions such that it is snugly received within the rebated portion 25. In assembling the valve the flow control member is introduced into the body of the rigid tubular portion 15 until it is snugly engaged in the rebated portion 25. As stated above the flow control member 20 has a tubular configuration however the walls of the flow control member 20 are of varying thickness whereby the thickness of the flow control member 20 is least in the region of the discharge outlet 16 and is greatest in the region opposite the discharge outlet 16. The end of the flow control member 20 adjacent the diaphragm 22 is formed with a diametric member 21 extending between the thickest and thinner portions of the wall of the flow control member 20 and an outwardly directed axial button is formed centrally on the diametric member 21 such that it abutts the diaphragm.

If desired the end of the flow control member adjacent the diaphragm 22 may be formed with at least two axial cutaway 24 adjacent the diametric member 21.

Figure 5:
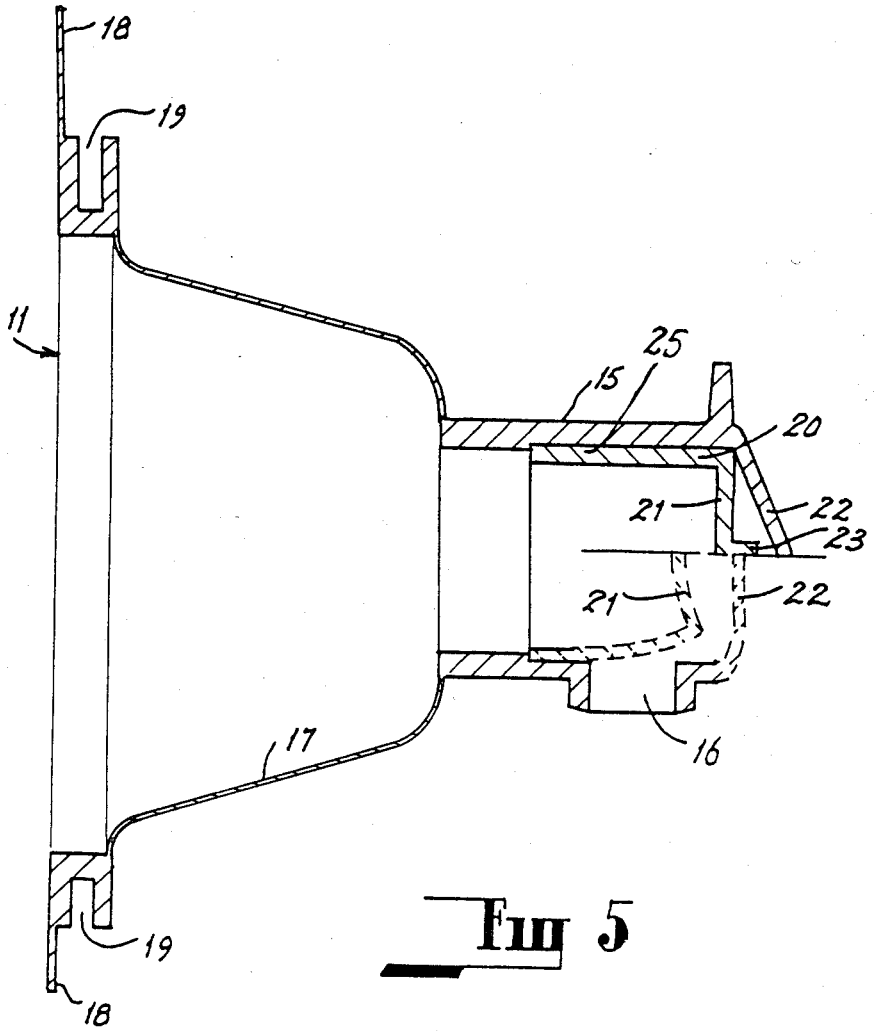
FIG. 5 is a cross-sectional elevation showing the tubular member in the closed and open positions.
Figure 2:
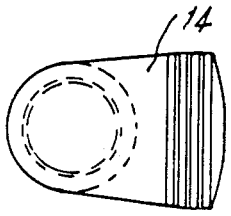
FIG. 2 is an inverted plan view of the discharge outlet seal of the embodiment.

In use the dispensing valve is mounted to a flexible container which is to be filled through another opening formed in the container. Once the filled container is in position within its outer container the dispensing valve is accommodated within its inoperative position within the flange 18 and container while in storage. To use the valve the rigid tubular portion 15 is extracted from within the container and the removable seal 14 is removed from the discharge outlet 16. On inward deformation of the diaphragm the button 23 on the diametric member 21 is engaged by the diaphragm to cause inward deformation of the diametric member. This deformation causes deformation of the flow control member at its weakest point which comprises the portion of the flow control member at which it is thinnest. This deformation of the flow control member is further enhanced by the utilisation of the small axial cutaways 24 in the region of the diametric member 21 which provide a hinge-like facility. As shown at FIG. 5 the deformation of the flow control member 20 results in fluid flow between the internal walls of the rigid tubular portion 15 and the external wall of the flow control member 20 in the region of the diaphragm 22 to the discharge outlet 16. On removal of the deforming pressure on the diaphragm 22 the diametric member 21 resiliently returns to its undeformed state to cut off fluid flow to the discharge outlet 16. This cutt off of fluid flow is assisted by the internal pressure within the container.

As a result of the embodiment a dispensing valve is produced which once in position upon a container provides no source of contamination of the contents of the container. When it is desired to use the dispensing valve some degree of communication is provided to the contents of the container by removal of the seal 14 over the discharge outlet 16.

It should be appreciated that if desired the flow control member 20 may be welded or bonded to the rigid tubular member 15 once in position.

In addition it should be appreciated that the body of the valve may be formed of any suitable material which provides the flexible functions required of the flexible skirt 17 and the diaphragm 22 and yet also provide the rigid characteristics required of the rigid tubular portion 15. In addition if desired the valve may be formed of metal by the provision of articulation between the flow control member and the diaphragm and a bellows-like configuration of the diaphragm.

It should be appreciated that the scope of the present invention need not be limited to the particular scope of the embodiment described above.

I claim:

1. A dispensing valve for a fluid container comprising a cylindrical body portion having an inlet at one end adapted to be mounted to a container, the other end of the cylindrical portion being closed by an integral resiliently deformable diaphragm, a discharge outlet in a cylindrical side wall of the cylindrical portion, a resilient cylindrical tubular flow control member axially affixed within said cylindrical portion and having an imperforate cylindrical side wall normally closing said discharge outlet, a projecting portion integrally formed on said tubular flow control member at one end of said imperforate cylindrical side wall and juxtaposed to said diaphragm, said diaphragm being deflectable by a user to engage said projecting portion for resilient deflection of at least a portion of said imperforate cylindrical side wall of said flow control member for movement relative to said discharge outlet between the normally closed position and an open position for dispensing a fluid from the container.

2. A dispensing valve as claimed in claim 1 wherein said valve is mounted to a flexible container which is adapted to be stored within a rigid container.

3. A dispensing valve as claimed at claim 1 wherein a tear off seal is fixed over the discharge outlet.

4. A dispensing valve as set forth in claim 3 wherein the tear off seal is formed integrally with the discharge outlet and is connected thereto by a weakened section for facilitating removal.

5. A valve as claimed in claim 1 wherein said flow control member is axially affixed within a cylindrical recess formed at the other end of said tubular portion and overlies the discharge outlet, the wall of the flow control member in the region of said discharge outlet is deformed on deformation of the diaphragm.

6. A dispensing valve as claimed at claim 5 wherein said flow control member is formed with a diametric member located adjacent the diaphragm with which the projecting portion is integrally formed.

7. A dispensing valve as claimed at claim 5 wherein the wall of the flow control member is of reduced thickness in the region of the discharge outlet.

8. A dispensing valve as claimed at claim 1 wherein said valve also comprising an integral tubular flexible skirt adapted at one end to be sealingly engaged with an opening in the container and integrally joined at the other end to one end of said tubular body portion for movement of said valve between a retracted position at which the valve is located substantially within a container and an operative position at which the valve is located to the exterior of the container.

9. A dispensing valve as set forth in claim 8 wherein a tear off seal is fixed over the discharge outlet.

10. A dispensing valve as set forth in claim 9 wherein the tear off seal is formed integrally with the discharge outlet and is connected thereto by a weakened section for facilitating removal.

* * * * *